United States Patent [19]

Jeyes et al.

[11] 3,937,593

[45] Feb. 10, 1976

[54] ROTOR ASSEMBLIES

[75] Inventors: John Anthony Jeyes; Ronald Edward Blakeley, both of Solihull, England

[73] Assignee: Joseph Lucas (Industries) Limited, Birmingham, England

[22] Filed: Mar. 18, 1974

[21] Appl. No.: 452,463

[30] Foreign Application Priority Data

Apr. 17, 1973 United Kingdom ..... 18408/73

[52] U.S. Cl. ..... 416/214 A; 416/241 B

[51] Int. Cl.[2] ..... F01D 5/30

[58] Field of Search.... 416/214, 214 A, 241, 241 B, 416/215, 216

[56] References Cited

UNITED STATES PATENTS

| | | | |
|---|---|---|---|
| 2,981,517 | 4/1961 | Georges | 416/214 A |

FOREIGN PATENTS OR APPLICATIONS

| | | | |
|---|---|---|---|
| 879,755 | 3/1943 | France | 416/241 B |
| 826,996 | 1/1952 | Germany | 416/241 B |
| 666,259 | 2/1952 | United Kingdom | 416/214 |
| 696,715 | 9/1953 | United Kingdom | 416/241 B |
| 939,505 | 10/1963 | United Kingdom | 416/241 B |

OTHER PUBLICATIONS

Gas Turbine International, Jan.–Feb., 1973, pp. 30–36.

*Primary Examiner*—Everette A. Powell, Jr.
*Attorney, Agent, or Firm*—Holman & Stern

[57] ABSTRACT

In a rotor assembly, first and second annular discs are axially spaced apart on a rotatable shaft so as to be rotatable with the shaft. A plurality of rotor blades are located between the discs and are angularly spaced around the axis of the shaft, and means urges the discs against the blades so that a root portion of each blade is trapped between the discs with the remainder of the blade projecting from the discs. Each root portion is shaped so as to be non-complementary with the portions of the discs between which it is trapped, and each disc is shaped so as to present to each root portion first and second surfaces which, when the shaft is rotated in use, engage respective spaced regions of the root portion so that the root portion is held against axial movement relative to the shaft and against movement radially outwardly relative to the axis of the shaft.

8 Claims, 5 Drawing Figures

ROTOR ASSEMBLIES

Figure 1:
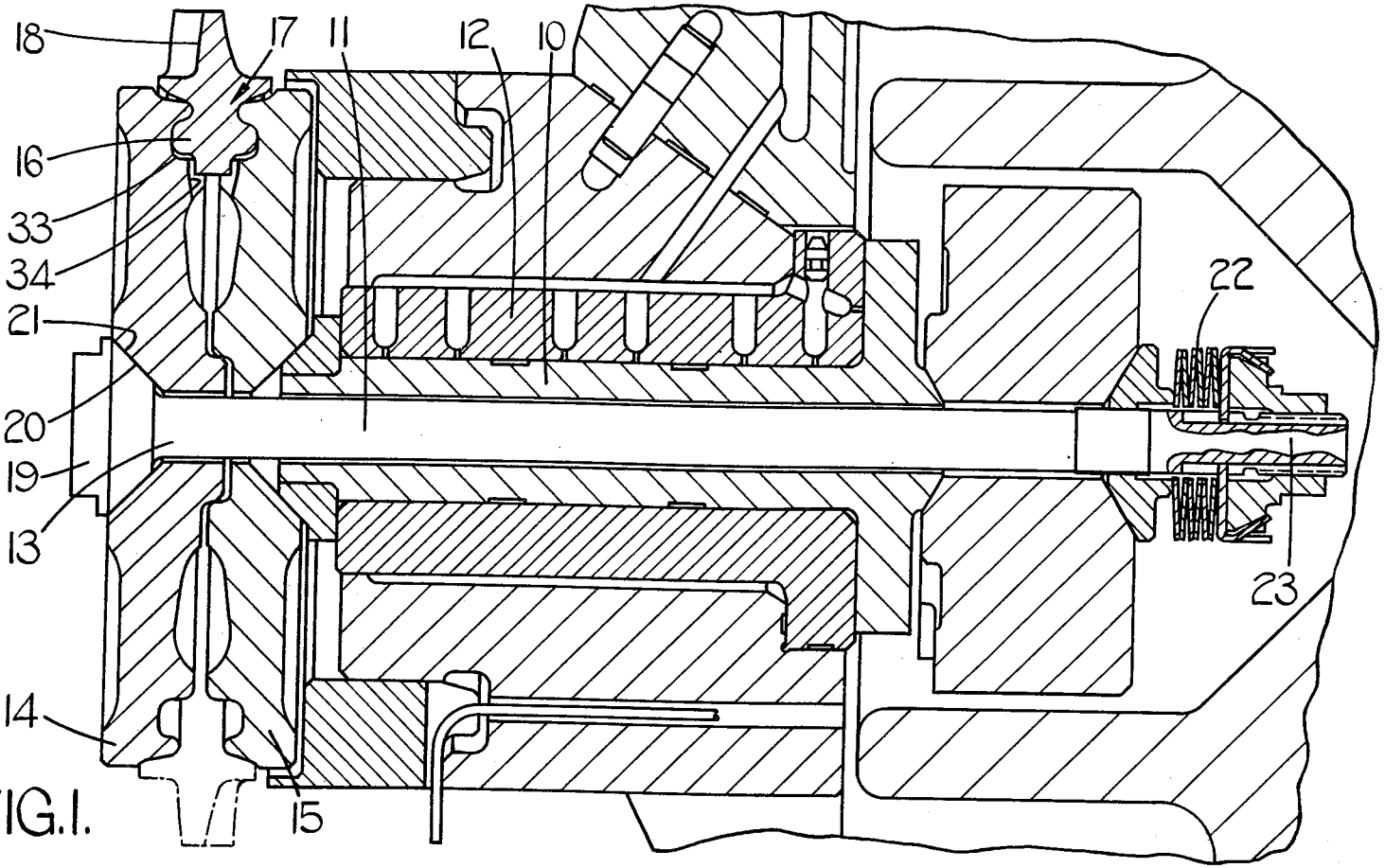

This invention relates to rotor assemblies.

In a first aspect, the invention resides in a rotor assembly comprising a rotatable shaft, first and second annular discs axially spaced on the shaft and rotatable with the shaft, a plurality of rotor blades located between the discs and angularly spaced around the axis of the shaft, and means urging the discs against the blades so that a root portion of each blade is trapped between the discs with the remainder of the blade projecting from the discs, each root portion being shaped so as to be noncomplementary with the portions of the disc between which it is trapped, and each disc being shaped so as to present to each root portion first and second surfaces which, when the shaft is rotated in use, engage respective spaced regions of the root portion so that the root portion is held against axial movement relative to the shaft and against movement radially outwardly relative to the axis of the shaft.

Preferably, the first surface of each disc presented to a respective root portion extends in a plane substantially perpendicular to the axis of the shaft and is urged by said means against a parallel, planar surface of the root portion so that the root portion is held between said first surfaces of the discs against axial movement relative to the shaft.

Preferably, the second surface of each disc presented to a respective root portion is arranged so that, when the shaft is rotated, a further surface of the root portion is urged by centrifugal force against said second surface and the reaction at any point between the surfaces is substantially perpendicular to the axis of the shaft or subtends an angle with the axis of the shaft such that the component of the reaction in a direction parallel with the shaft is insufficient to overcome the friction between the surfaces and therefore to cause relative movement of the surfaces.

Preferably, the second surface of each disc presented to a respective root portion and said further surface of the root portion are curved about the axis of the shaft, with the radius of the curve defined by the second surface being greater than that of the curve defined by said further surface so that there is point contact between surfaces.

In a second aspect, the invention resides in a rotor assembly comprising a rotatable shaft, first and second annular discs spaced apart axially on the shaft and rotatable therewith, a plurality of rotor blades mounted between the discs and angularly spaced around the axis of the shaft, and resilient means acting on the shaft to cause a portion of the shaft to urge the first disc in a direction parallel with the axis of the shaft and towards the second disc, the latter being held against movement in said direction, whereby the rotor blades are trapped between the discs.

In a third aspect, the invention resides in a rotor assembly comprising a rotatable shaft, first and second annular discs rotatable with the shaft and spaced apart axially along the shaft, a plurality of rotor blades located between the discs and angularly spaced around the axis of the shaft, and means urging the discs against the blades so that a root portion of each blade is trapped between the discs with the remainder of the blade projecting from the discs, the arrangement being such that when the shaft is rotated the root portion of each blade and the portions of the discs, between which said root portion, is trapped together define respective interengaging abutments arranged so that the blade is held against angular movement relative to the discs about the axis of the shaft.

Preferably, the root portion of each blade includes an extension which projects into a slot defined by the discs, and each slot is arranged so that in use when the shaft is rotated the respective extension engages a wall of the slot so as to define with the wall said interengaging abutments.

Preferably, the walls of each slot which are spaced apart angularly relative to the axis of the shaft are parallel and each extension is a sliding fit at room temperature between the parallel walls of its respective slot.

Preferably, the rotor blades are formed from hot pressed silicon nitride.

Figure 2:
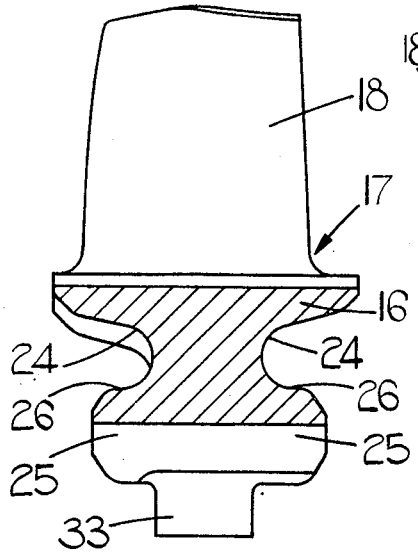
Figure 3:
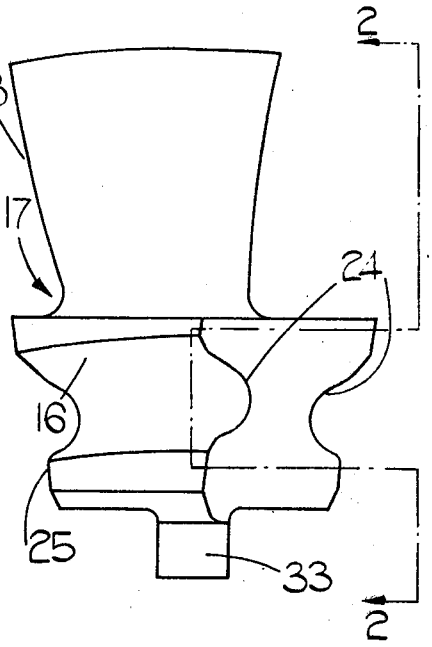
Figure 4:
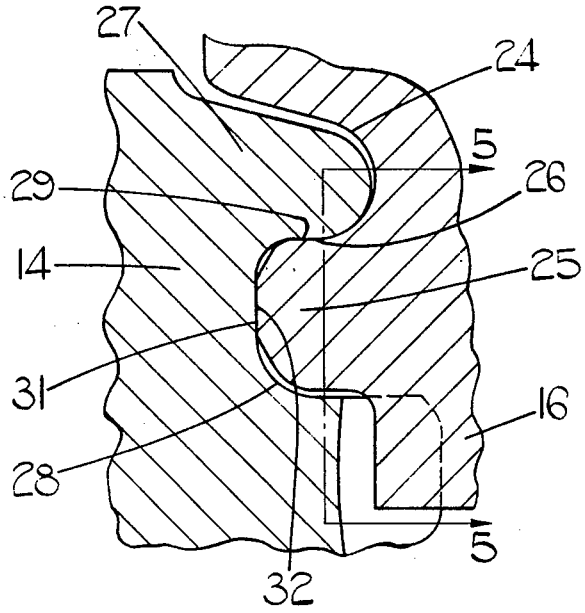
Figure 5:
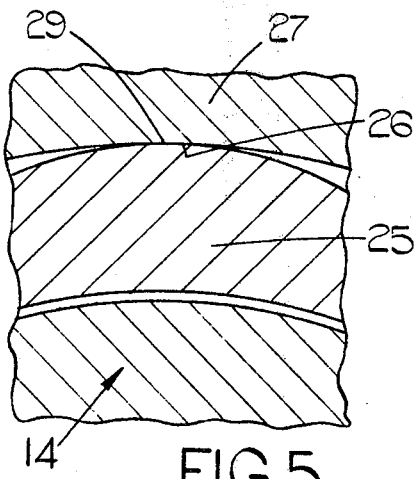

In the accompanying drawings, which illustrate one example of the invention,

FIG. 1 is a sectional view of part of a rotor assembly,

FIG. 2 is a view taken along line 2—2 in FIG. 3, the view looking in the direction of the arrows, FIG. 3 is an end view of the rotor blade shown in FIG. 2, FIG. 4 is a sectional view to an enlarged scale of part of the assembly shown in FIG. 1, showing part of a rotor blade and part of one of the discs, and, FIG. 5 is a view taken along line 5—5 in FIG. 4, the view looking in the direction of the arrows.

Referring to the drawings, the rotor assembly includes a metal shaft 11 which is rotatable with a silicon nitride sleeve 10 within an air-lubricated bearing 12. The shaft 11 extends at one end 13 from the sleeve 10, and clamped between the end 13 of the shaft 11 and the sleeve 10 so as to be rotatable therewith are first and second annular, metal discs 14, 15 respectively. The discs 14, 15 are axially spaced along the shaft and trapped between the external peripheries of the discs is the root portion 16 of each of a plurality of rotor blades 17. The rotor blades 17 are equi-angularly spaced around the axis of the shaft 11 and are arranged so that the aerofoil section 18 of each blade 17 projects from the peripheries of the discs 14, 15. The blades 17 are formed of hot pressed silicon nitride.

At its one end 13, the shaft 11 is provided with a head portion 19 which presents an inclined surface 20 to the disc 14 which in turn is provided with a complementary surface 21. The shaft 11 is capable of a limited amount of axial movement relative to the sleeve 10, but a plurality of disc springs 22 provided at the other end 23 of the shaft 11 urge the shaft in a direction such that the inclined surface 20 is pressed against the surface 21. The springs 22 thereby exert an axial clamping force on the disc 14 so causing the disc 14 to trap the root portions 16 of the blades 17 against the disc 15, the latter being held against the sleeve 10. In this way, the blades 17 are held against movement relative to the discs 14, 15 in a direction parallel with the axis of the shaft 11. Also, the provision of the disc spring 22 caters, when the rotor assembly is being used at an elevated temperature, for any differential axial thermal expansion between the metal components (i.e., the shaft 11 and discs 14, 15) and the silicon nitride components (i.e., the rotor blades 17 and the sleeve 10). The metal components would normally be formed of a nimonic alloy, i.e., a high temperature nickel/iron alloy.

As shown best in FIGS. 2 to 4, the surfaces of each root portion 16 presented to the discs 14, 15 respectively are identical and each surface includes an elongated, open ended groove 24 and a projection 25 adjacent the groove 24 so that the groove and projection 25 share a common side wall 26. In addition, the mutually presented surfaces of the discs 14, 15 at each of the portions thereof which are presented to a respective root portion 16 are identical and each defines a projection 27 and a groove 28 presented to the groove 24 and projection 25 respectively of the associated root portion 16. However, the grooves 24 of each root portion 16 are shaped so that although the respective projections 27 are received therein, the projections 27 are non-complementary with the grooves 24. Further, the arrangement is such that, in use when the shaft 11 is rotating so that centrifugal forces urge the blades 17 radially outwardly, the side wall 26 of each groove 24 engages the associated projection 27 at a surface 29 thereof and the remainder of the projection is spaced from the walls of the groove 24. Each surface 29 thereby prevents its respective root portion 16 from moving radially outwardly under the action of the centrifugal forces acting on the root portion as the shaft 11 rotates and the arrangement of each surface 29 is such that the centrifugal reaction at any point between the surface 29 and side wall 26 extends in a direction substantially perpendicular to the axis of the shaft. Alternatively the surface 29 and side wall 26 can be arranged so that the centrifugal reaction subtends an acute angle with the axis of the shaft, provided the component of the reaction in a direction parallel with the shaft is insufficient to overcome the friction between the surface 29 and side wall 26 and therefore to cause relative movement therebetween.

The projections 25 of each root portion 16 are arranged to be received in their respective grooves 28 in the discs 14, 15, but each groove 28 is shaped so that the respective projection 25 is non-complementary therewith. Further, each groove 28 defines at its base a flat surface 31 which extends in a plane perpendicular to the axis of the shaft 11 and which is urged, under the action of the springs 22 against a parallel flat surface 32 defined at the free end of the respective projection 25. The remainder of the projection 25 remains spaced from its associated groove 28. Thus, each root portion 16 is held between the surfaces 31 against movement relative to the discs 14, 15 in a direction parallel with the axis of the shaft 11.

As shown in FIGS. 3 and 5, each groove 24 is curved along its length and about the axis of the shaft 11. Each projection 27 is similarly curved, but the radius of curvature of the projection 27 is greater than that of its associated recess 24 so that there is point contact between each surface 29 and the respective side wall 26. In this way tensile stresses in the blade roots 16 and the discs 14, 15 are minimised, which is particularly important since the blades 17 are formed from hot pressed silicon nitride.

The root portion 16 of each blade 17 is provided with an integral extension 33 which projects into a slot 34 defined in part by each of the discs 14, 15. The walls of each slot 34 which are spaced apart angularly relative to the axis of the shaft 11 are parallel and the respective extension 33 is arranged so that at room temperature (about 20°C) it is a sliding fit between the parallel walls of the slot. Each slot 34 thereby holds its respective blade 17 against angular movement relative to the discs 14, 15 about the axis of the shaft 11 when the shaft is rotated. Thus the slots 34 serve to ensure that the spacing between adjacent blades 17 remain unchanged even when the assembly is being rotated at high speed so that out-of-balance forces are thereby minimised.

It is to be appreciated that since the root portions 16 and the discs 14, 15 do not have to conform accurately with one another over their entire mating surfaces, manufacture of the discs 14, 15 requires only a relatively simple machining process.

We claim:

1. A rotor assembly comprising a rotatable shaft, first and second annular discs axially spaced on the shaft and rotatable with the shaft, a plurality of rotor blades located between the discs and angularly spaced around the axis of the shaft, and means urging the discs against the blades so that a root portion of each blade is trapped between the discs with the remainder of the blade projecting from the discs, each root portion being shaped so as to be non-complementary with the portions of the disc between which it is trapped, and each disc being shaped so as to present to each root portion first and second surfaces which, when the shaft is rotated in use, engage first and second spaced regions respectively of the root portion so that the root portion is held respectively against movement radially outwardly relative to the axis of the shaft and against axial movement relative to the shaft, said first surface of each disc presented to a respective root portion being curved about the axis of the shaft and the associated first region of said respective root portion being defined by a further surface which is similarly curved about the axis of the shaft, but which has a radius less than the radius of the curve defined by said first surface so that there is point contact between the surfaces.

2. A rotor assembly as claimed in claim 1 wherein the second surface of each disc presented to a respective root portion extends in a plane substantially perpendicular to the axis of the shaft and is urged by said means against a parallel, planar surface of the root portion so that the root portion is held between said second surfaces of the disc against axial movement relative to the shaft.

3. A rotor assembly as claimed in claim 1 wherein the first surface of each disc presented to a respective root portion and the associated further surface of the root portion are arranged so that, when the shaft is rotated, the reaction to centrifugal forces at any point between the surfaces is substantially perpendicular to the axis of the shaft or subtends an angle with the axis of the shaft such that the component of the reaction in a direction parallel with the shaft is insufficient to overcome the friction between the surfaces and therefore to cause relative movement of the surfaces.

4. A rotor assembly as claimed in claim 1 wherein said means acts on the shaft to cause a portion of the shaft to urge the first disc in a direction parallel with the axis of the shaft and towards the second disc, the latter being held against movement in said direction, whereby the rotor blades are trapped between the discs.

5. A rotor assembly as claimed in claim 1 wherein the root portion of each blade and the portions of the discs, between which said root portion is trapped, together define respective mutually presented abutments which are urged into interengagement when the shaft is rotated so that the blade is held against angular movement relative to the discs about the axis of the shaft.

6. A rotor assembly as claimed in claim 5 wherein the root portion of each blade includes an extension which projects into a slot defined by the discs, and each slot is arranged so that in use when the shaft is rotated the respective extension engages a wall of the slot so as to define with the wall said interengaging abutments.

7. A rotor assembly as claimed in claim 6 wherein the walls of each slot which are spaced apart angularly relative to the axis of the shaft are parallel and each extension is a sliding fit at room temperature between the parallel walls of its respective slot.

8. A rotor assembly as claimed in claim 1 wherein the rotor blades are formed from hot pressed silicon nitride.

* * * * *